US005553467A

United States Patent [19]

Calabro

[11] Patent Number: 5,553,467

[45] Date of Patent: Sep. 10, 1996

[54] ADJUSTABLE EAR CLIP

[76] Inventor: Anthony S. Calabro, 51 Church Hill Dr., Cranston, R.I. 02920

[21] Appl. No.: 618,029

[22] Filed: Mar. 25, 1996

Related U.S. Application Data

[63] Continuation-in-part of Ser. No. 437,574, May 9, 1995.

[51] Int. Cl.[6] ..... A44C 7/00

[52] U.S. Cl. ..... 63/14.5; 24/514

[58] Field of Search ..... 63/12, 14.1, 14.3, 63/14.4, 14.5; 24/514, 525, 616

[56] References Cited

U.S. PATENT DOCUMENTS

| | | | |
|---|---|---|---|
| 2,417,117 | 3/1947 | Marcus | 63/14.3 |
| 3,159,894 | 12/1964 | Haug | 63/14.5 X |
| 3,176,475 | 4/1965 | Saccoccio | 63/14.5 |
| 3,987,644 | 10/1976 | Saccoccio | 63/14.5 |
| 4,188,799 | 2/1980 | Saccoccio | 63/14.5 |
| 4,756,168 | 7/1988 | Saccoccio | 63/14.5 |
| 4,796,443 | 1/1989 | Bannister et al. | 63/14.5 |

*Primary Examiner*—Joanne Silbermann
*Attorney, Agent, or Firm*—Barlow & Barlow, Ltd.

[57] ABSTRACT

An adjustable ear clip device for relieving pressure on the ear lobe of a wearer is provided. The adjustable ear clip includes a base plate with a pair of spaced ears connected thereto. An angled stop plate emanates from the base plate at a location adjacent to the bottom of a notch in the base plate. A mounting plate is connected to the base plate to receive an ornamental member. An ear engaging member includes a pair of spring-biased arms for engaging the ears. A spring tongue is positioned between the arms and has a stop bolt aperture therethrough. A stop bolt is threaded through the spring tongue and engages with the angled stop plate to limit the travel of the ear engaging member toward the ornamental member.

5 Claims, 6 Drawing Sheets

ADJUSTABLE EAR CLIP

BACKGROUND OF THE INVENTION

This patent application is a continuation-in-part of patent application Ser. No. 08/437,574 filed May 9, 1995.

The present invention relates generally to an ear clip to be incorporated into a jewelry item. More specifically, the present invention relates to an ear clip which may be adjustable to limit the pressure of the clip applied to the wearer's ear lobe.

It is well known in the earring industry that a person without pierced ears may affix an earring jewelry member to the ear lobe. Typically, a spring biased clip is employed to retain the clip on the wearer's ear lobe. A pair of members, which snap together under pressure, are commonly used. In this type of construction, the spring pressure employed should be strong enough to suit different thicknesses of ear lobe and, frequently, the spring pressure transferred to the wearer's ear lobe is uncomfortable due to pinching the ear lobe. On the other hand, the spring tension of the ear clip may be insufficient causing the ear clip to be too loose which often results in the ear clip completely falling off the wearer's ear lobe.

There have been many attempts in the prior art to control the spring tension in a resulting pressure on a wearer's ear lobe. In addition, various prior art devices provide a way for the user to select a custom tension or pressure level of the ear clip to make it more comfortable to wear. For example, U.S. Pat. No. 4,829,789, issued to Tsamas, discloses a variable pressure earring clasp which is capable of varying the gripping pressure applied to the ear lobe. A pressure controller is slideably mounted on a center prong of the clasp so that by sliding the pressure controller, the gripping pressure of the clasp may be decreased or increased as desired. U.S. Pat. No. 5,170,644, issued to Calabro, and U.S. Pat. No. 3,020,734, issued to Withers, both generally disclose an adjustable spring clamp for earrings where the throw of the earring gauging member is limited by a ratcheting-type structure. Also, U.S. Pat. No. 2,803,119, issued to Jellinek, discloses a jewelry clip with a spring-biased clamping arm to enable the user to vary the pressure applied to the ear lobe when the ear clip is worn.

Prior art attempts to provide a structure, which enables the user to vary the pressure applied to the ear lobe, suffer from various shortcomings and disadvantages. These prior art devices typically require many additional parts and require substantial additional tooling. Further, limitations of these adjustable pressure ear clips can only be carried out in certain environments, namely certain types of ear clips. For example, the structure disclosed in the Jellinek patent, discussed above, can only be carried out in a "French clip" style earring. It would be impossible to carry out such a pressure controlled arrangement in the environment of a "paddle clip", for example. In particular, prior art ear clip devices fail to provide a structure for controlling the ear clip pressure to a wearer's ear lobe in a "paddle clip" environment which is preferred by earring wearers due to their comfort and styling. However, prior art devices which provide such ear lobe pressure control in an "paddle clip" environment require substantial additional tooling and/or require many additional parts. As a result, the prior art devices are inadequate to provide an adjustable ear clip in a "paddle clip" style which is simple and inexpensive to manufacture yet still comfortable to wear.

Due to the demand for a "paddle clip" style adjustable earring clip, it is desirable for an ear clip to retain the "paddle clip" general configuration for comfort of the wearer as well as attractive styling. In addition, it is also desirable for a "paddle clip" to undergo minor modification, with few additional parts, to achieve a clip capable of adjusting the clip pressure in accordance with the wearer's comfort level.

SUMMARY OF THE INVENTION

The present invention preserves the advantages of prior art adjustable ear clips employed in the jewelry industry. In addition, it provides new advantages not found in currently available adjustable ear clip devices, and overcomes many disadvantages of such currently available devices.

The invention is generally directed to a novel and unique adjustable ear clip device with particular application in providing an ear clip which is precisely adjustable to the wearer's comfort level. The adjustable ear clip of the present invention enables the simple, easy and inexpensive assembly, and use of an adjustable ear clip without requiring elaborate tooling or significant modification to a standard paddle clip assembly.

The preferred embodiment of the present invention includes four primary members. A support structure generally includes a base plate with a pair of ears connected to opposing ends of the base plate. The ears are positioned substantially perpendicular to the base plate and each include a pivot aperture therethrough. A stop plate is connected to an end of the base plate which is not connected to the ears. A stop plate is connected to the base plate at an angle greater than 90° relative to the base plate. A mounting plate is then connected to the stop plate. An ornamental member, such as a jewelry finding, is connected directly to the mounting plate. An ear engaging member includes a pair of arms and a spring tongue positioned therebetween. Each of the arms include protrusions at their ends which engage with the pivot apertures and the pair of ears. The spring tongue includes a stop bolt aperture therethrough for threadably receiving a stop bolt. The spring tongue rests on an end of the base plate which is opposite the end on which the stop plate is connected. The stop bolt, which has male threading thereon, is threadably positioned through the stop bolt aperture and is engageable with the stop plate to limit the travel of the ear engaging member toward the ornamental member. The amount the stop bolt is threaded through the stop bolt aperture will determine how much the travel of the ear engaging member is limited. In addition, a knob is provided on one end of the stop bolt to facilitate rotation and a foot is provided on the opposing end of the stop bolt to provide good contact with the stop plate.

In an alternative embodiment of the invention, a notch is provided in the end of the base plate on which the spring tongue rests. Emanating from the bottom portion of the notch is a stop plate member for contacting the stop bolt to limit the travel of the ear engaging member toward the ornamental member. Compared to the preferred embodiment, the location of the stop plate is changed from between the base plate and the mounting plate to a position emanating from the base plate at the stop bolt notch.

In operation, the wearer rotates the knob connected to the stop bolt to cause the stop bolt to thread through the spring tongue so that the foot comes into communication with the stop plate. Further rotation of the stop bolt causes the ear engaging member to elevate from the ornamental member thereby reducing the pressure on a wearer's ear lobe. The user may, at this point, try the ear clip on to test the current pressure for comfort. If additional pressure relief is needed, the stop bolt is further threaded into the spring tongue to further separate the ear engaging member from the ornamental member thus adjusting the pressure. When the wearer is satisfied with the level of pressure, the stop bolt is left alone to retain the desired amount of travel limitation of the ear engaging member toward the ornamental member. The clip may be opened when the wearer does not wish to wear the earrings any longer and the stop bolt will remain in the desired positioned in the spring tongue to limit the travel of the ear engaging member on subsequent uses by the wearer while retaining the custom pressure setting.

It is therefore an object of the present invention to provide an adjustable ear clip that can quickly modify the pressure applied to a wearer's ear lobe.

Another object of the present invention is to provide an adjustable ear clip which retains its custom pressure settings over many uses.

It is a further object of the present invention to provide an adjustable ear clip that can be inexpensively assembled while retaining a paddle clip style.

It is yet a further object of the present invention to provide an adjustable ear clip which requires few additional parts without the requirement of significant additional tooling.

It is another object of the present invention to provide an adjustable ear clip which maintains the style of a traditional paddle clip earring with the additional comfort of custom pressure settings.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
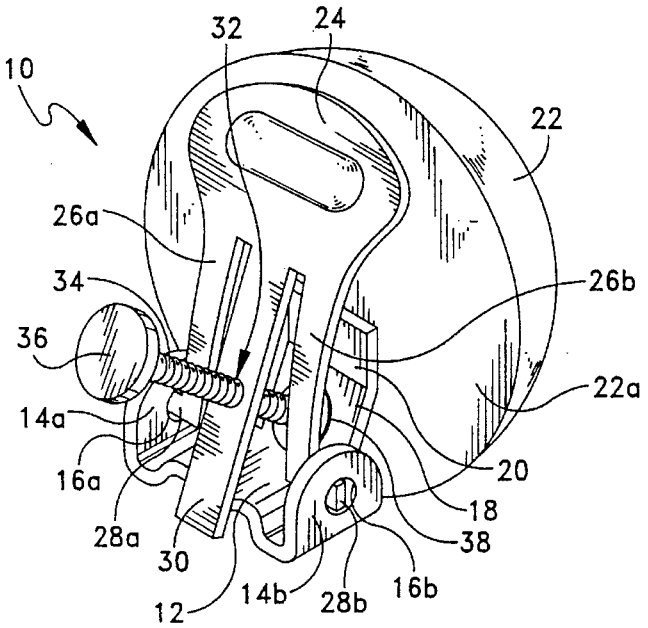
FIG. 1 is a perspective view of the adjustable ear clip of the present invention.

Referring to FIG. 1, the adjustable ear clip 10 of the present invention is shown. The adjustable clip 10 includes a base plate 12 with a pair of ear members **14*a* and 14*b* connected to opposing sides thereof. Ear members 14*a* and 14*b* are generally positioned perpendicular relative to base plate 12. Left ear member 14*a* includes pivot aperture 16*a* and right ear member 14*b* includes pivot aperture 16*b*. An ear engaging member 24 includes arms 26*a* and 26*b*. Left arm 26*a* includes protrusion 28*a* for engagement with left pivot aperture 16*a*. Similarly, right arm 26*b* includes protrusion 28*b* for engaging right pivot aperture 16*b*. Arms 26*a* and 26*b* are jaw-like and are spring-biased so that arms 26*a* and 26*b* can be squeezed toward one another to permit protrusions 28*a* and 28*b* to clear ear members 14*a* and 14*b* to enter pivot apertures 16*a* and 16*b*. The spring-biased configuration of arms 26*a* and 26*b* maintain protrusions 28*a* and 28*b* seated within their respective apertures 16*a* and 16*b*. A spring tongue 30 is also connected to ear engaging member 24 and is disposed between arms 26*a* and 26*b*. Spring tongue 30 rests on one of the ends of base plate 12**.

Figure 2:
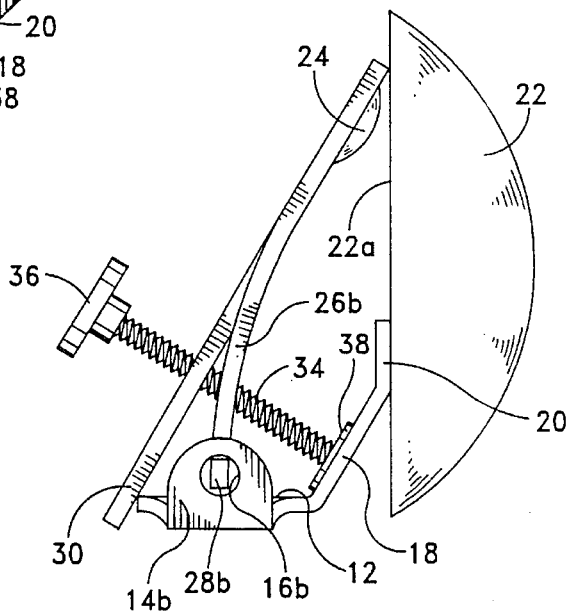
FIG. 2 is a side view of the adjustable ear clip of FIG. 1 in a closed-condition.

Spring tongue 30 includes a stop bolt aperture 32 for receiving threaded stop bolt 34 therethrough. Positioned on one end of stop bolt 34 is knob 36. The opposing end of threaded stop bolt 34 is foot 38 for communicating with angled stop plate 18 which is connected to base plate 12. Referring now to FIG. 2, the communication of foot 38 with angled stop plate 18 and the interconnection to an ornamental member 22 can be seen. As best seen in FIG. 2, angled stop plate 18 is connected to base plate 12 at an angle greater than 90° relative to one another. Connected on the free end of angled stop plate 18 is mounting plate or solder pad 20 which communicates with the rear surface **22*a* of ornamental member 22. In the side view of FIG. 2, ear engaging member 24 contacts rear surface 22*a* of ornamental member 22. As will be discussed in detail below, threaded stop bolt 34 is rotated and thereby threaded through spring tongue 30 to elevate ear engaging member off rear surface 22*a*** to alleviate pressure.

Figure 3:
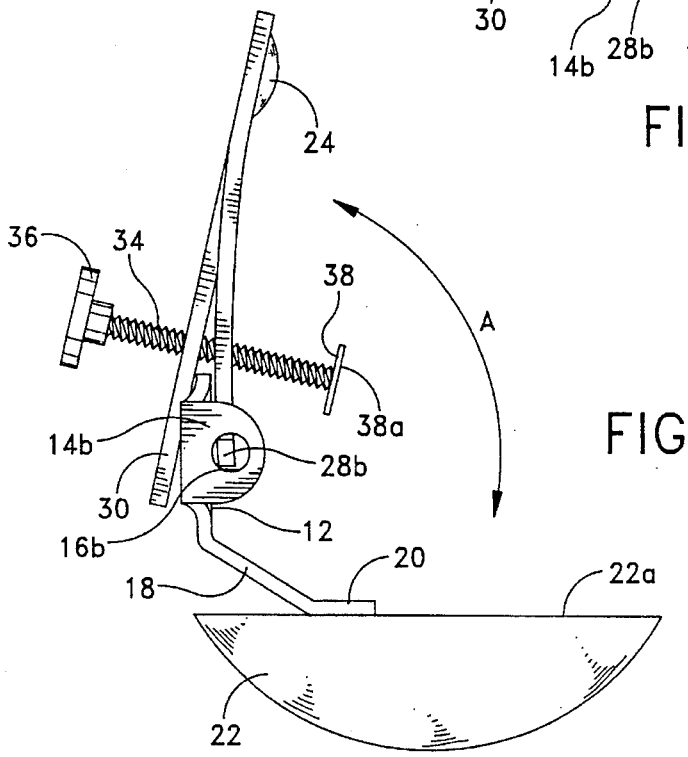
FIG. 3 is a side view of the adjustable ear clip of FIG. 1 in an opened condition.

FIG. 3 illustrates a side view of the present invention in an opened condition. As can be seen, the addition of a threaded stop bolt 34 through spring tongue 30 and the inclusion of angled stop plate 18 does not affect the normal operation of the illustrated paddle-style clip. As in normal use, as indicated by reference numeral A, the clip can be opened and closed as with a common paddle-style ear clip.

Figure 4:
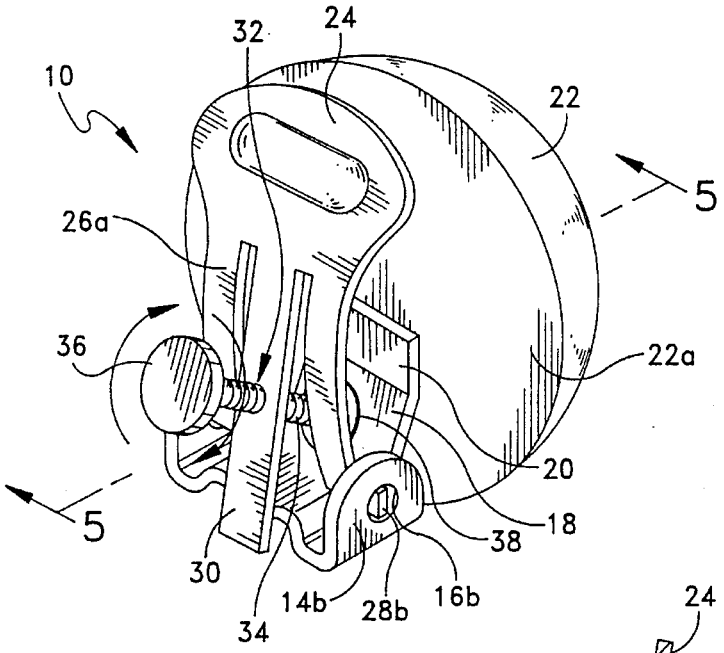
FIG. 4 is a perspective view of the adjustable ear clip is adjusted to relieve pressure in accordance with the present invention.
Figure 5:
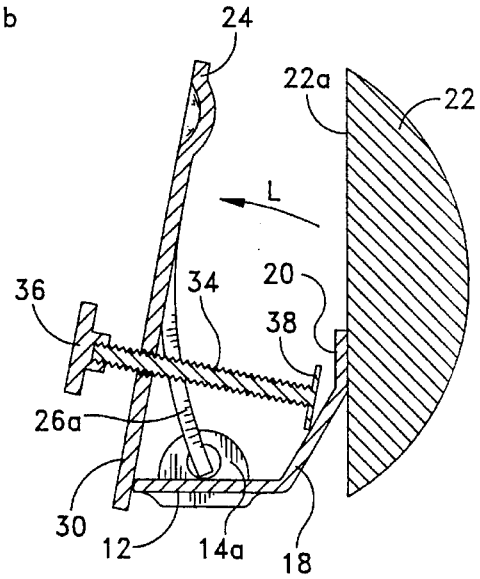
FIG. 5 is a cross-sectional view through the line 5—5 of FIG. 4.

Turning now to FIG. 4, employment of stop bolt 34 and angled stop plate 18 is shown in accordance with the present invention. Preferably, knob 36 is provided on one end of stop bolt 34 to facilitate the rotation of the stop bolt 34. On the opposing end of stop bolt 34 is foot 38 to provide increased surface area for contact for angled stop plate 18. FIG. 4 illustrates the ear clip of the present invention where stop bolt 34, via knob 36, has been rotated several turns in the clockwise direction to screw threaded bolt 34 further in through spring tongue 30. As seen in FIG. 5, the rotation of stop bolt 34 into spring tongue 30 causes ear engaging member 24 to lift off rear surface 22*a* of ornamental member 22 as indicated by the arrow reference "L".

Turning back briefly to FIGS. 1 and 2, the spring construction of arms 26*a*, 26*b* and spring tongue 30 urge ear engaging member 24 to its maximum travel point which is rear surface 22*a*. However, the stop bolt 34 in FIGS. 1 and 2 has not yet been threaded into spring tongue 30 enough to alleviate pressure. Referring now to FIGS. 4 and 5, the additional threading of stop bolt 34 into spring tongue 30 effectively limits the travel of rear engaging member 24 towards ornamental member 22. As seen in FIG. 5, a gap remains between rear engaging member 24 and ornamental member 22.

Figure 6:
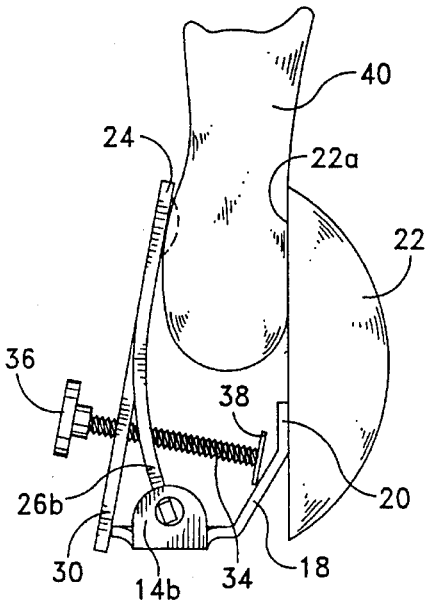
FIG. 6 is a side view of the adjustable ear clip of FIG. 4 attached to a wearer's ear lobe with pressure adjusted.

FIG. 6 illustrates use of the present invention on an ear lobe of a wearer. In the use of the present invention, knob 36 is rotated to thread stop bolt 34 through spring tongue 30 to the desired position where ear engaging member 24 is the desired position away from rear surface 22*a*. When the desired gap is created, the entire ear clip is opened in similar fashion to that seen in FIG. 3 but with the stop bolt 34 threaded to the desired pressure relieving position. The adjustable ear clip of the present invention remains open in similar fashion to a common paddle-type ear clip. The ear lobe 40 of the wearer is then inserted between ear engaging member 24 and rear surface 22*a* of ornamental member 22. Ear engaging member 24 is then moved toward rear surface 22*a* against the forces of spring tongue 30. When ear engaging member 24 is moved enough along path A, as seen in FIG. 3, ear engaging member 24 will be biased toward rear surface 22*a*. However, stop bolt 34, with foot 38 thereon, will prevent travel of ear engaging member 24 all the way to rear surface 22*a* as seen in FIG. 2. The limitation of travel of ear engaging member 24 prevents excessive pinching of ear lobe 40. As can be understood, stop bolt 34 can be threaded in and out through spring tongue 30 to adjust the gap between ear engaging member 24 and rear surface 22*a* to accommodate ear lobes of varying thicknesses and comfort levels of the particular wearer. Various additional optional structures, as will be discussed below, may be provided to prevent ear lobe 40 from being pinched between foot 38 and mounting plate 20.

The base plate may be integrally formed with ear members 14*a* and 14*b* as well as angled stop plate 18 and mounting plate 20. Preferably, the foregoing components are formed from a single sheet of material, die cut and then bent into position. The ear engaging member 24, arms 26*a*, 26*b* and spring tongue 30 are preferably made from a single piece of material. Each of the foregoing components are preferable made of a metal alloy material, such as No. 8 to No. 10 spring-tempered phosphor bronze. In addition, a wide range of ornamental members may be affixed to mounting plate 20, such as a precious or non-precious jewelry finding.

Figure 7:
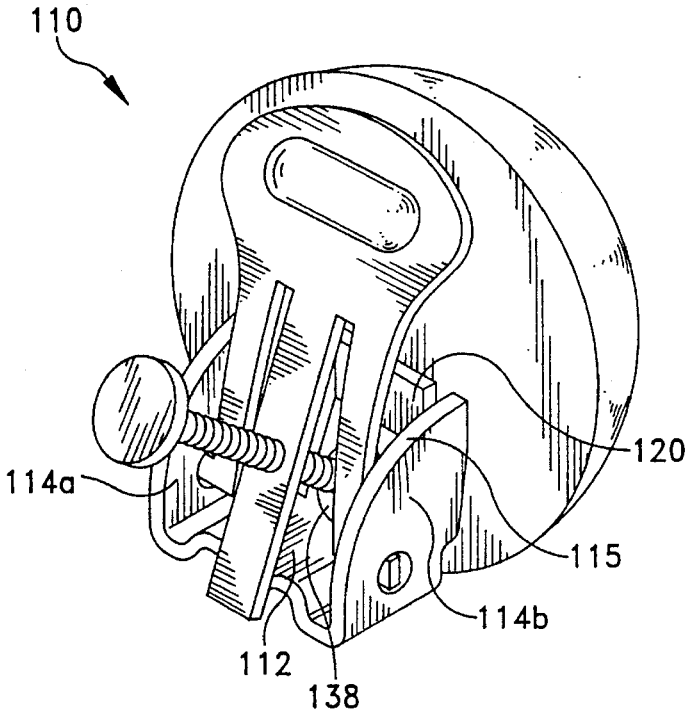
FIG. 7 is a perspective view of an alternative embodiment of the adjustable ear clip of the present invention.
Figure 8:
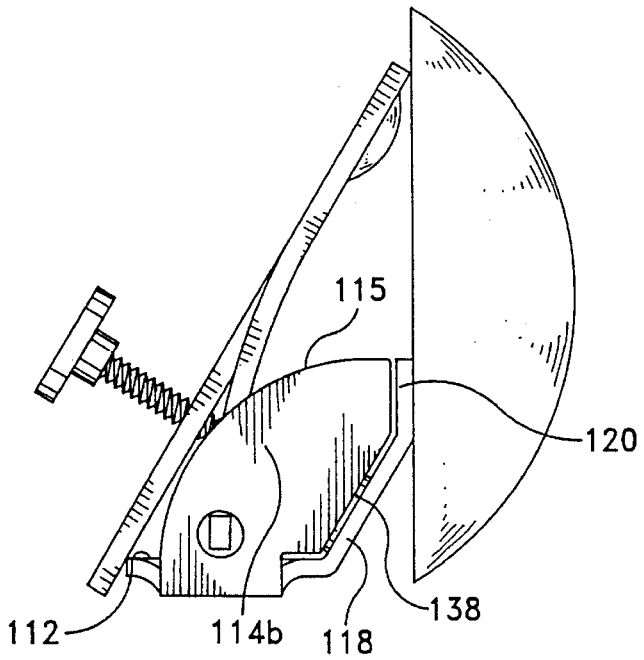
FIG. 8 is a side view of the alternative embodiment of FIG. 7.

FIGS. 7–17 illustrate alternative embodiments of the S adjustable ear clip present invention which address various optional safety enhancements and variations of the invention. Turning first to FIGS. 7 and 8, a first alternative embodiment of the present invention is shown. The adjustable ear clip 110 includes a base plate 112 with a pair of ear members 114*a* and 114*b* connected to opposing sides thereof. Ear members 114*a* and 114*b* are generally positioned perpendicular relative to base plate 112. Ear members 114*a* and 114*b* are enlarged compared to the ear members 14*a* and 14*b* of the preferred embodiment of FIGS. 1–6 for additional safety precautions to protect the wearer's ear lobe from being pinched between foot 138 and angled stop plate 118 or mounting plate 120. Each of the enlarged ear members 114*a* and 114*b* have an semi-circular edge 115 to contact an ear lobe should it get too close to foot 138 thus preventing it from being pinched. Preferably, ear members 114*a* and 114*b* have a configuration to substantially mate with angled stop plate 118 and mounting plate 120 at a 90° angle to be more aesthetically pleasing. However, the shape and configuration of ear members 114*a* and 114*b* may be modified according to design specifications.

Figure 9:
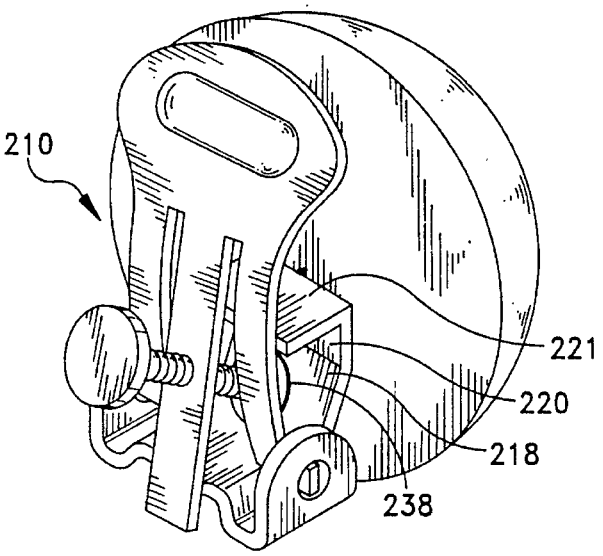
FIG. 9 is perspective view of a second alternative embodiment of the adjustable ear clip of the present invention.

Turning now to FIG. 9, a perspective view of a second alternative embodiment of the ear clip of the present invention is shown. To further enhance safety of the ear clip 210, an upstanding wall 221 is provided preferably extending from mounting plate 220 at an approximate 90° angle therefrom. Upstanding wall 221 effectively prevents a wearer's ear lobe from approaching too close to foot 238 which may permit the wearer's ear lobe to be pinched between foot 238 and angled stop plate 218 or mounting plate 220. Thus, upstanding wall 221 isolates foot 238 from the wearer's ear lobe as a further safety precaution.

Figure 10:
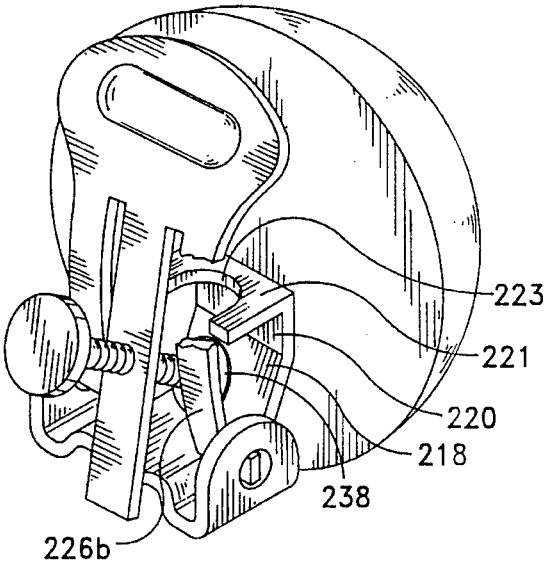
FIG. 10 is a perspective view of a third alternative embodiment of the adjustable ear clip of the present invention.
Figure 11:
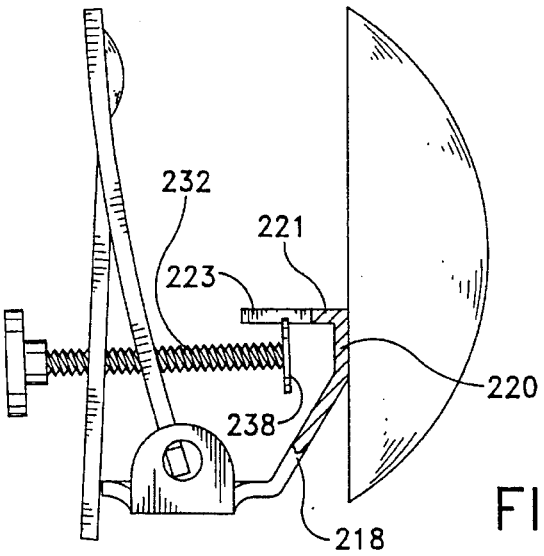
FIG. 11 is a side view with a partial cross-section of the third alternative embodiment of FIG. 10.

As seen in FIGS. 10 and 11, a third alternative embodiment of the ear clip of the present invention is shown. The third embodiment, as compared to the second alternative embodiment, further includes a clearance notch 223 in upstanding wall 221 to permit foot 238 to pass through when the clip is opened while not reducing the height of wall 221. Right arm 226B is broken away to permit clearance notch 223 to be seen. Reducing the height of upstanding wall 221 would lessen its ability to block a wearer's ear lobe from approaching the foot 238. Clearance notch 223 is employed when upstanding wall 221 is relatively close to angled stop plate 218 when forming a compact clip arrangement. If upstanding wall 221 is not positioned close to angled stop plate 218, clearance notch 223 is not required because foot 238 will be permitted to clear upstanding wall 221.

Figure 12:
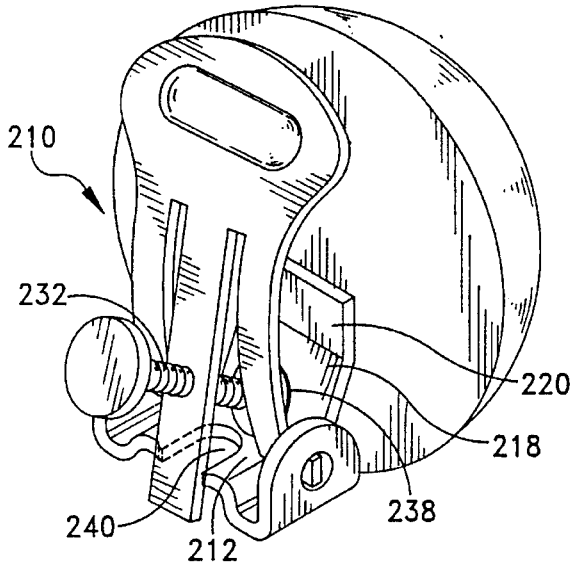
FIG. 12 is a perspective view of the fourth alternative embodiment of the adjustable ear clip of the present invention.
Figure 13:
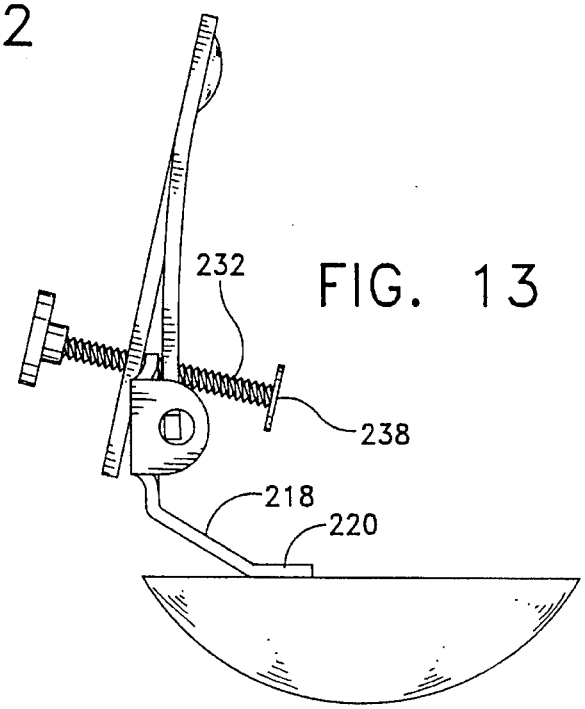
FIG. 13 is a side view of the ear clip of FIG. 12.
Figure 14:
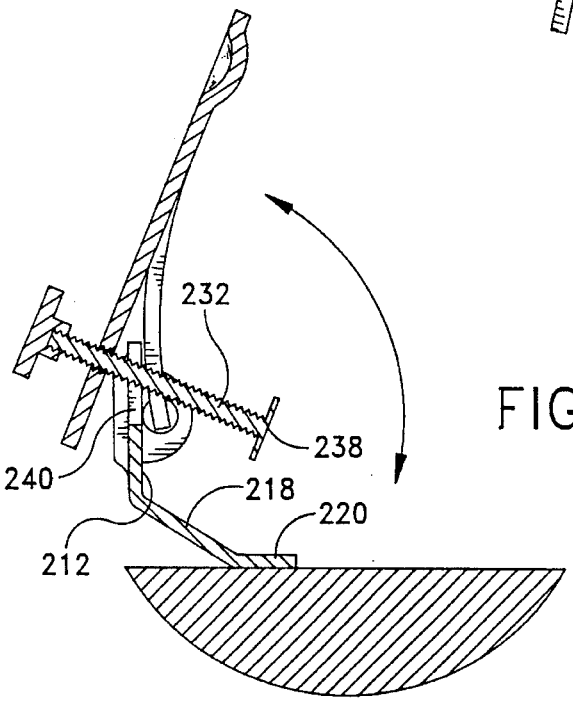
FIG. 14 is a cross-sectional view through the line 14—14 in FIG. 12.

FIGS. 12–14 illustrate the fourth embodiment of the present invention where base plate 212 includes a bolt notch 240. When the ear clip 210 is manufactured in a compact fashion, stop bolt 232 may not be permitted to clear the top of base plate 212 when clip 210 is opened. The bolt notch 240 enables the employment of stop bolt 232 without sacrificing a compact design. As seen in FIGS. 13 and 14, the ear clip 210 is in an opened condition where stop bolt 232 resides in bolt notch 240. As a result, operation of the ear clip 210 of the present invention remains unaffected.

Figure 15:
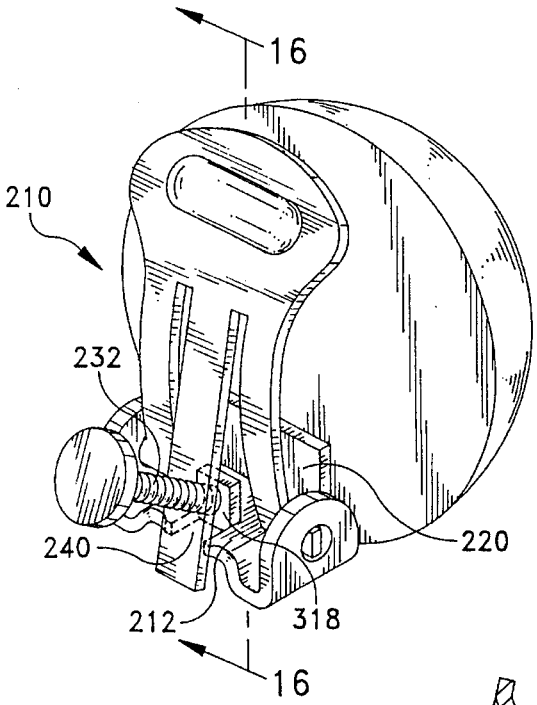
FIG. 15 is a perspective view of a fifth alternative embodiment of the ear clip of the present invention.
Figure 16:
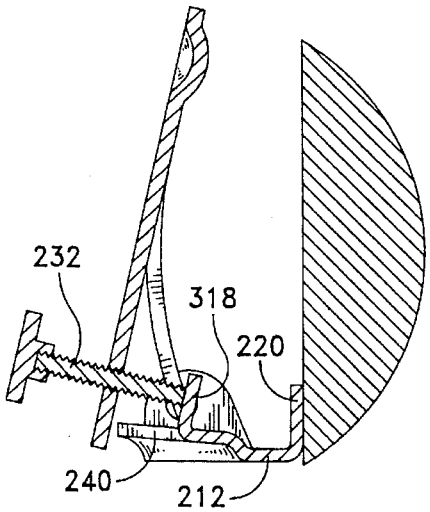
FIG. 16 is a cross-sectional view through the line 15—15 of FIG. 15 when the ear clip is in a substantially open condition.
Figure 17:
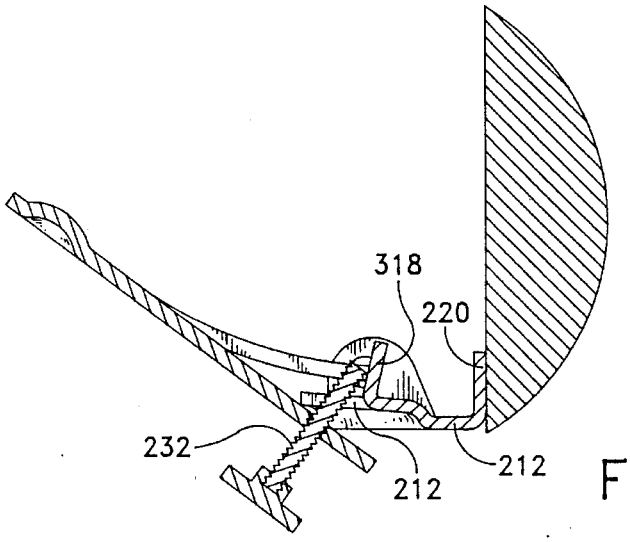
FIG. 17 is a cross-sectional view through the line 15—15 of FIG. 15 when the ear clip is in a closed condition.

As seen in FIGS. 15–17, the fifth embodiment of the invention is shown. This embodiment is similar to the embodiment shown in FIGS. 12–14 in that base plate 212 includes a bolt notch 240. This bolt notch 240 enables stop bolt 232 to clear the top of base plate 212 when clip 210 is opened. As a further way to provide a more compact design which is completely safe to the user, an angled stop plate 318 is provided as emanating directly from base plate 212.

Referring specifically to FIG. 15, a perspective view of the fifth alternative embodiment is shown. Mounting plate 220 is connected directly to base plate 212 which includes bolt notch 240 therein. Stop plate 318 is connected to base plate 212 at the base of bolt notch 240. In the manufacture of this fifth embodiment, the base plate 212 and mounting plate are formed by a stamping die which simultaneously cuts the bolt notch 240 and bends the stop plate 318 into place. The stop plate 318 is preferably from the same piece of material as the base plate 212 and is positioned at an angle less than 90° relative to base plate 212 in similar fashion to the stop plate 218 of the fourth embodiment of FIGS. 12–14.

FIG. 16 shows a cross-section through the line 16—16 of FIG. 15 when the ear clip 210 is in a closed condition while employing the adjustable tension relief of the present invention. Stop bolt 232 engages with stop plate 318 to control the tension of ear clip 210. FIG. 17 illustrates a cross-sectional view through the line 16—16 of FIG. 15 of the fifth embodiment where stop bolt 232 resides in bolt notch 240 when the clip 210 is in a substantially open condition.

The fifth alternative embodiment of FIGS. 15–17 provides additional safety in that the contact point of the stop bolt 232 to the stop plate 318 is set farther back toward base plate 212. As a result, the likelihood of a user's ear lobe being pinched between stop bolt 232 and stop plate 318 is greatly reduced. Further the location at stop plate 318 simplifies and reduces the cost of manufacture of the present invention.

The foregoing alternative embodiments may be employed alone or in combination with each other. For example, the enlarged ears 114*a* and 114*b* of FIGS. 7 and 8 may be employed along with the upstanding wall 221 with clearance notch 223 and bolt notch 240 in the base plate to create a structure which completely isolates the foot 238 from the wearer's ear during the attachment process.

It would be appreciated by those skilled in the art that various changes and modifications can be made to the illustrated embodiments without departing from the spirit of the present invention. All such modifications and changes are intended to be covered by the appended claims.

What is claimed is:

1. An adjustable pressure ear clip, comprising:

a base plate;

a pair of ears connected to opposing ends of said base plate; said ears being positioned substantially perpendicular to said base plate and each ear including a pivot aperture therethrough;

a mounting plate connected to said base plate;

said base plate including a bolt notch in a side opposite a side connected to said mounting plate; said bolt notch including a bottom portion; said stop bolt residing in said bolt notch when the clip is in an opened condition;

a stop plate connected to said base plate at a location adjacent to said bottom portion of said bolt notch;

an ornamental member connected to said mounting plate;

an ear engaging member;

a pair of arms connected to said ear engaging member; said arms each including protrusions at ends thereof not connected to said ear engaging member; said protrusions being positioned in said pivot apertures, respectively;

a spring tongue connected to said ear engaging member and disposed between said arms; said spring tongue including a stop bolt aperture therethrough; said spring tongue resting on a end of said base plate opposite the end on which said mounting plate is connected; and a stop bolt, having male threading thereon, threadably positioned through said stop bolt aperture and engageable with said stop plate to limit travel of said ear engaging member toward said ornamental member.

2. The ear clip as in claim 1, wherein said arms and said spring tongue have a controlled spring temper.

3. The ear clip as in claim 1, wherein said stop bolt is adjustable to control the distance of travel of said ear engaging member toward said ornamental member.

4. The ear clip of claim 1, further comprising:

a foot connected to an end of said stop bolt capable of engagement with said stop plate.

5. The ear clip of claim 1, further comprising:

a knob connected to an end of said stop bolt opposite the end of said stop bolt which is engageable with said stop plate.

* * * * *